US009132898B2

(12) United States Patent
Mier Maza

(10) Patent No.: US 9,132,898 B2
(45) Date of Patent: Sep. 15, 2015

(54) HYDRO-IMPELLED KAYAK PADDLE

(75) Inventor: Rafael Mier Maza, Queretaro (MX)

(73) Assignee: APLICACIONES SILIDRIEL, S.A. DE C.V., Queretaro, Qro. (MX)

( * ) Notice: Subject to any disclaimer, the term of this patent is extended or adjusted under 35 U.S.C. 154(b) by 586 days.

(21) Appl. No.: 13/550,043

(22) Filed: Jul. 16, 2012

(65) Prior Publication Data

US 2014/0017084 A1 Jan. 16, 2014

(51) Int. Cl.
*B63H 16/04* (2006.01)

(52) U.S. Cl.
CPC ..... *B63H 16/04* (2013.01)

(58) Field of Classification Search
CPC ..... B63H 16/00; B63H 16/04
See application file for complete search history.

(56) References Cited

U.S. PATENT DOCUMENTS

| | | | | |
|---|---|---|---|---|
| 4,610,633 | A * | 9/1986 | Freudenberg | 416/74 |
| 4,737,126 | A | 4/1988 | Lindeberg et al. | |
| 4,955,839 | A * | 9/1990 | Kaschper | 416/74 |
| 5,482,434 | A * | 1/1996 | Heaven | 416/70 R |
| 5,820,424 | A * | 10/1998 | Steinhour et al. | 440/101 |
| 6,210,244 | B1 * | 4/2001 | Nordby | 416/74 |
| 6,568,971 | B1 * | 5/2003 | Abbenhouse et al. | 416/70 R |
| 6,796,862 | B1 * | 9/2004 | Abbenhouse et al. | 416/74 |

* cited by examiner

*Primary Examiner* — Igor Kershteyn
(74) *Attorney, Agent, or Firm* — Egbert Law Office, PLLC

(57) ABSTRACT

A kayak paddle has blades configured to generate forward kayak momentum in each one of the three paddling movements, being more effective than known paddles, using its hydrodynamic profile to reduce formation of turbulent and eddy currents when moved in the water both, during insertion and retrieval. The paddle is characterized by a blade with a cross section in which both edges are curved, the frontal face is convex, and the back face is either flat, concave or both, but not convex, so as to benefit from the water flow around the surface or "Bernoulli Effect", specifically on insertion in deep water and retrieval from it, producing forward motion of the kayak due to such hydrodynamic forces.

4 Claims, 8 Drawing Sheets

HYDRO-IMPELLED KAYAK PADDLE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

This invention relates to a paddle used to improve forward propulsion of conventional kayaks, and specifically, the invention refers to a hydro-impelled paddle whose design allows the use of water patterns to generate forward propulsion during the full paddling process: from insertion in the water, pulling and extraction or retrieval out of the water.

2. Description of Related Art Including Information Disclosed Under 37 CFR 1.97 and 37 CFR 1.98.

The kayak, invented by Eskimo hunters, is a long narrow water vessel that allows fast displacement in rough or calm seas, by means of a paddle that sinks alternatively on both sides of the kayak, and is pulled backwards to attain forward propulsion. The paddle as has been used for centuries is a board with variable length and extremes flattened, with a width of less than 4" and a thickness less than 2", and gradually rounded towards the center or shaft to about 1¼ for hands placement and comfortable handling. The flat extremes or blades have two functions: to cut the water when immersing and taking out the water, and to power the boat forward, once it is deep by offering resistance to the pulling action. The action of immersing and taking out the paddle will have no effect on impelling the boat forward. The entry and exit are two necessary steps to get the blade deep where force is done.

The action of traditional paddles is exclusively based on water resistance against the flat cross section of the blade when pulled parallel to the longitudinal axis of the kayak, but opposite to the motion direction. In this way water is used as a support or resistance surface for propulsion. Nevertheless, around the blade there are eddies and turbulences exiting the side walls, resulting naturally in power loss.

Europeans copied the kayak scheme, but not the traditional paddles, developing paddles made with an almost 6 feet shaft and two wide, flat, concave or spoon shaped blades on the extremes. They are made of wood, or a metal shaft and plastic blades or fiberglass reinforced plastic or carbon reinforced plastic, on either shaft and/or blades. Among improvements, some paddles are made with some asymmetry with respect to the shaft axis.

The most important innovation is the so called "Lituanian paddle" described in U.S. Pat. No. 4,737,126 (Lindeberg, et al. 1988), consisting of wing shaped euro blades, so as to get higher water grip and power. The blade design has the leading edge rounded and the trailing edge sharpened, with a convex frontal or "reverse" face and a concave back or "power" face.

The effect achieved by Lindeberg's paddle is so notable that it became the Olympic standard, and all modern competing paddles use this principle, with only small variations on the curved shape or tilting with respect to the shaft axis. The "Euro modified Paddle" or "Wing Paddle", once immersed in the water, with the blade in an almost vertical position, travels horizontally and perpendicular to the boat displacement. The motion is horizontal after immersion, starting by the front of the boat and as close as possible to the hull, and emerging by the user's hip, two or three feet away from the boat. Looking from above it appears as an inverted V, with the tip in front of the boat and the open side by the waist, alternating sides in the paddling action. The effect of the wing blade traveling horizontally away from the boat, with an almost vertical shaft, is to propel the boat forwards.

All the motion and effect of the Wing Paddle is unidirectional. The blade enters the water fast, and is displaced sideways and the exit is at the end of that trajectory.

The mentioned Wing Paddles are not useful for those who paddle using the Greenland style with long thin narrow paddles and flat blades. Greenland paddles use the flat and sharp edge to cut the water and immerse deeply, close to the kayak hull. Once in the bottom the flat cross section serves to power the boat still close to the kayak, and when the pulling action is finished the paddle must exit from the bottom slicing the water with the sharp edge. Motion is decomposed in three stroke sections: Insertion to depth, pulling, and retrieval from bottom.

Lindeberg's paddle could perform the first two motions, if user wanted to use it in that way, entry to depth using the curved leading side, pull at the bottom with certain torsion due to the asymmetry of the blade placed with its maximum cross-section pushing against the water, but paddle extraction would not be possible. The reason being that the sharp edge would become the leading edge and the convexity on one side and concavity on the other creates turbulence and forces a violent rotation of the paddle with the consequence of loss of speed and stability.

BRIEF SUMMARY OF THE INVENTION

Taking into account the limitations of the devices in the state of the art, the present invention describes a kayak paddle wherein its geometry will give forward impulse during the three paddling stroke sections.

The invention provides a paddle with a blade whose leading edge is rounded and whose front face is convex and whose back face is not, as to use the powering forces provided by the water pattern, to give forward impulse, in the action of inserting the paddle during the paddle stroke.

The paddle of this invention has a blade whose leading edge is rounded and whose front face is convex and whose back face is not, as to use the powering forces provided by the water pattern, to give forward impulse, in the action of retrieving or retracting the paddle during the paddle stroke.

This invention relates to a kayak paddle whose blade is built to produce forward momentum in each one of the three steps in a paddle stroke; is more efficient than traditional paddles, by using the hydrodynamic profile to conform the water pattern in order to increase efficiency when moved in the water during the actions of insertion and retrieval.

The paddle according the invention is characterized by blades with a cross section showing two curved edges, the front face has a convex curvature, while the back or power face has a concave curvature, flat or combination of both, (but not convex), in such a way that the forces resulting from the water flow on the blades behave as in an airplane wing according to the "Bernoulli Effect" especially during the motions of insertion in and retrieval from the water, generating a forward momentum as an effect of such hydrodynamic forces.

These and other objects of the invention will be evident from the following description and the accompanying drawings.

DETAILED DESCRIPTION OF THE INVENTION

The invention relates to a kayak paddle, made as one piece with two blades at the ends developing from a shaft or loom, used to propel a kayak, whose blade has an optimal design to generate more momentum than traditional paddles, by using a hydrodynamic profile to make a more efficient use of water behavior specially during insertion in water and retrieval from it. The paddle produces forward motion in each one of the three parts of a paddle stroke, that is, during insertion in water, pulling to displace the kayak forward and retrieval from water, when used following the three movements of the Greenland style paddling.

Figure 1:
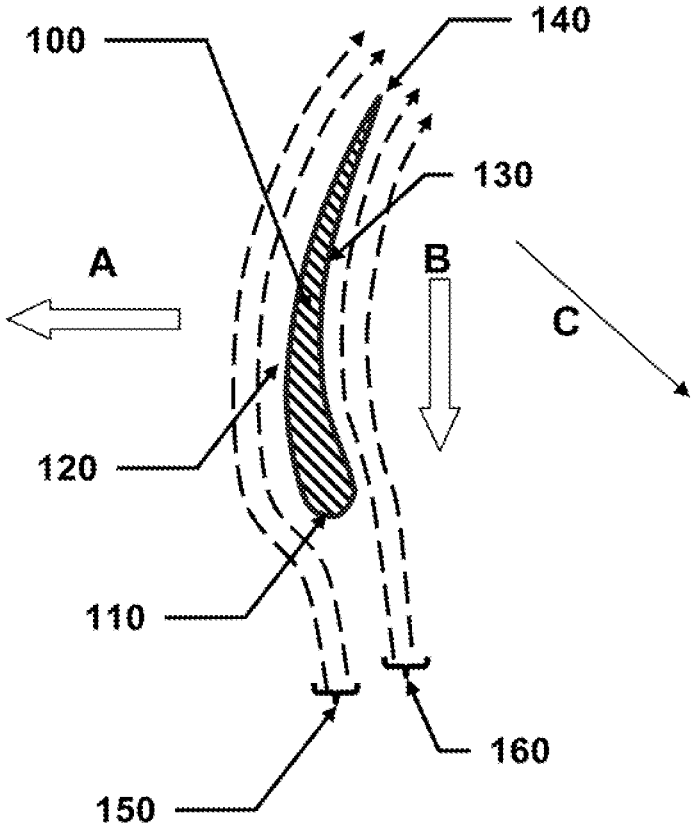
(prior art) Figure 1
FIG. 1 is a schematic view of the water flow pattern produced by a conventional blade during insertion.

FIG. 1 shows schematically the water flow pattern for a conventional paddle (100) of the type proposed by Lindeberg, whose lower edge (110) is rounded, and whose upper edge (140) is sharpened, a convex wall (120) giving the hydrodynamic benefits equivalent to the aerodynamics of an airplane wing. It is easy to see that the front curvature (120), reduces the water pressure due to the increase of the surface area, whose effect is the flow pattern (150) that yields a forward momentum on the paddle blade, as indicated by arrow "A", and in consequence, on the kayak.

A conventional blade of this type has a concave back side (130), which keeps the water pattern (160) on this face when the blade is moved in the direction "B", producing a kayak displacement in the "C" direction, creating a forward momentum. This effect is due to the wing shape of the rounded leader edge (110), and the sharpened trailing edge (140), with front convexity (120) and back concavity (130). The blade (100) enters the water with the axis almost vertical until submerged; the blade (100) displaces laterally away from the boat, with the powering effect that occurs with motion in only one direction, from the boat outwards.

In Wing paddles, and any paddle with the same blade asymmetry, with leading edge rounded and trailing edge sharpened, the effect cannot be achieved in the opposite direction.

Figure 2:
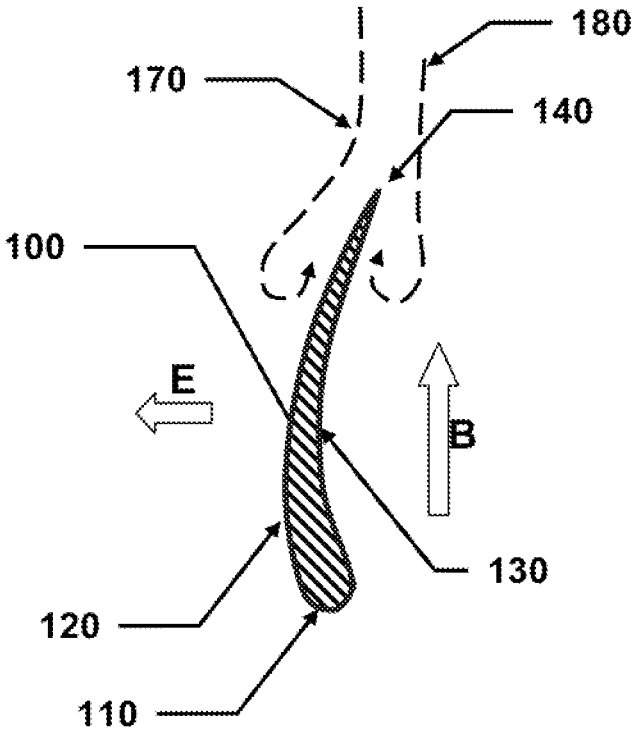
(prior art) Figure 2
FIG. 2 is a schematic view of the water flow pattern produced by a conventional blade during retrieval or extraction.

FIG. 2 shows the movement of the blade (100) out of the water, where the leading edge is the upper (140); the opposite edge being sharp, when moved backwards, produces a turbulence and eddies (170), (180) on both faces (120), (130), which lowers power efficiency (arrow "E") when trying to pull the blade back towards the boat. It is also clear that the differences in water pattern creates a rotation of the blade and the possibility of capsize. That paddle is intended to be used in only one direction and FIG. 2 shows what would happen if attempts are made to reverse it.

For the description of advantages of the present invention, the following figures show the preferred embodiment of the paddle, with curved edges as well as front and back faces curved.

Figure 3:
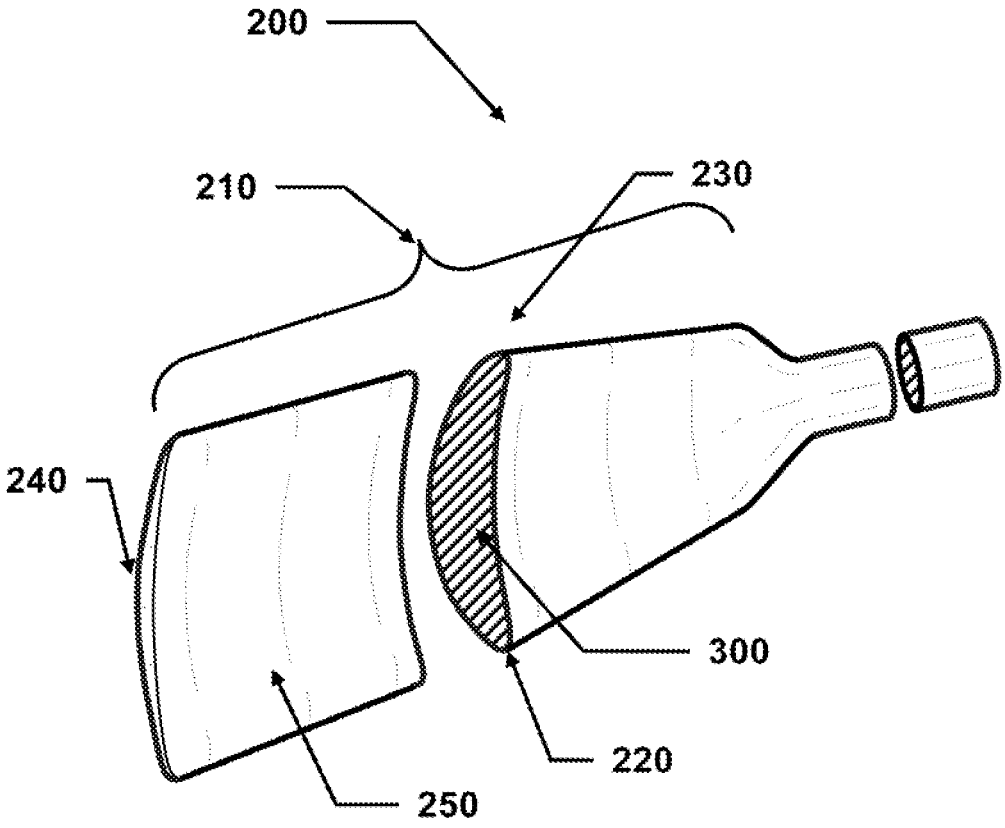
FIG. 3 is a schematic cross section of the hydro-impelled paddle of this invention.

FIG. 3 shows schematically the hydro-impelled paddle of this invention (200). The paddle blade (200) has a cross-section (300), with the upper (230) and lower (220) edges being rounded, the front face (240) is convex and the back face or power face (250) being flat, concave or channeled but not convex; the blade section smoothens towards the shaft or loom (210) where kayaker put his/her hands on.

As previously mentioned, the hydrodynamic blade of the paddle of the invention (200), can be used with the three movements of Greenland stroke style: motion starts up with a frontal attack, immersion of the blade in the water to the bottom, pulling, and retrieval from the bottom; the cycle repeats on the other side. The three movements are next described as well as the action of the hydro-impelled paddle of the invention.

Figure 4A:
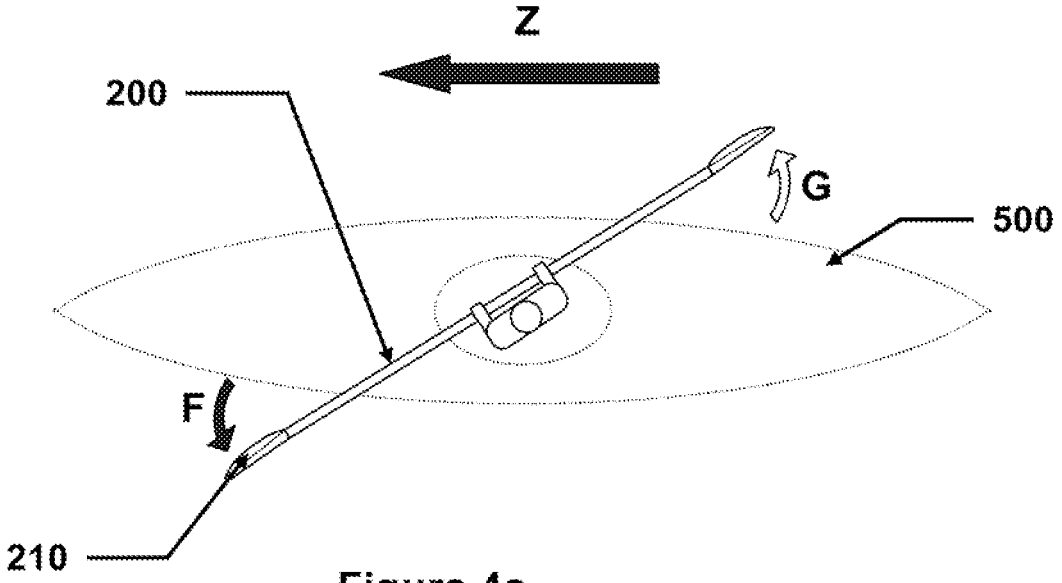
FIG. 4*a* is a schematic top view of the insertion movement of the hydro-impelled paddle of this invention while paddling.
Figure 4B:
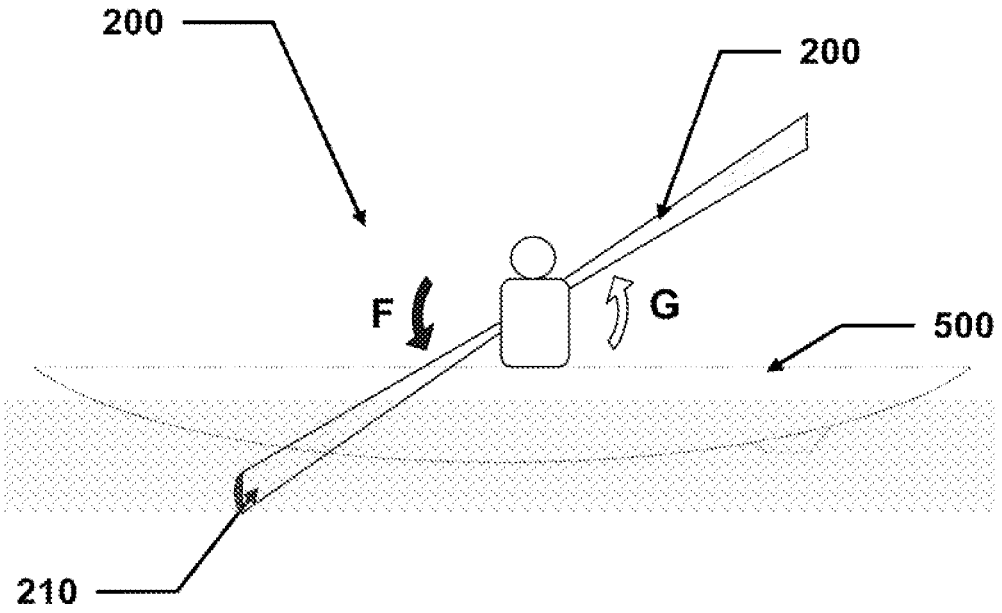
FIG. 4*b* is a side schematic view of the insertion movement of the hydro-impelled paddle of this invention while paddling.
Figure 5:
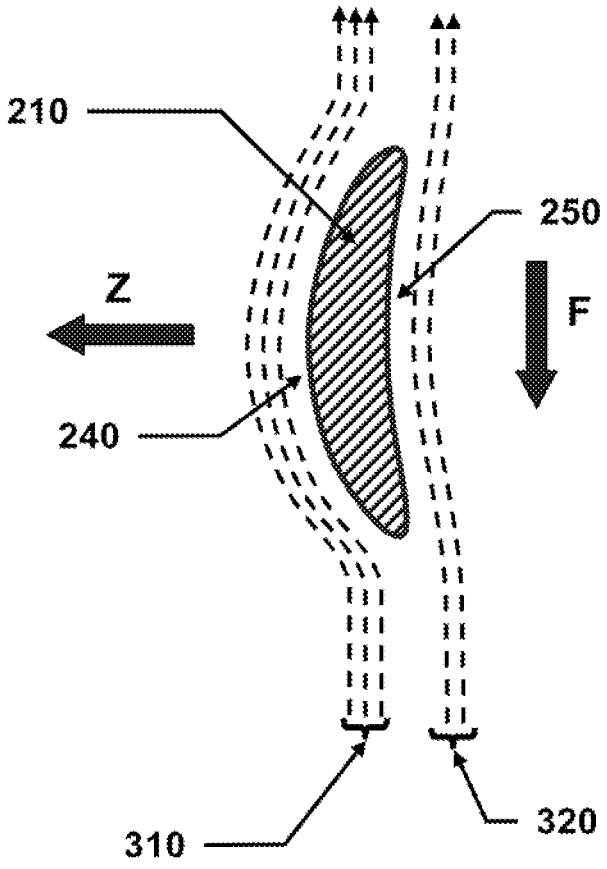
FIG. 5 is a schematic view of water flow pattern produced by a hydro-impelled paddle of the invention during the vertical movement of insertion.

Insertion.—During insertion, represented schematically in the top view in FIG. 4*a*, and on FIG. 4*b* on a side view, one of the paddle blades (210) is introduced vertically "F" in the water, rising the correspondent opposite blade "G". Insertion is performed at one point in the front part of the kayak (500). As the blade is being rapidly lowered (200) a flow pattern develops as shown in FIG. 5, where water follows the curvature in the front face (240) as if water would rise (310), and in the back face (250) following an almost straight path. This difference in the water flow lines (310) and (320), generates a pressure change, being less in the front, powers the kayak forward in the "Z" direction according to "Bernoulli" principle.

Figure 6A:
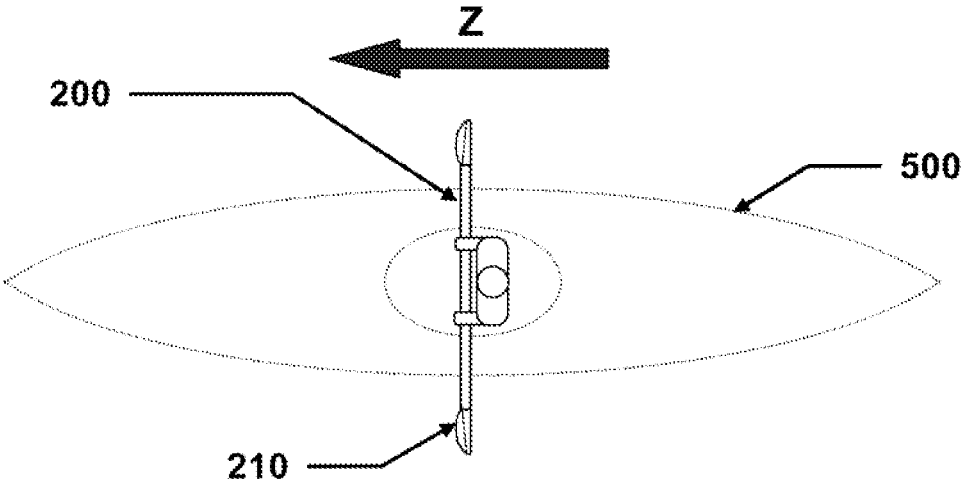
FIG. 6*a* is a top schematic view of the pulling movement of the hydro-impelled paddle of this invention while paddling.
Figure 6B:
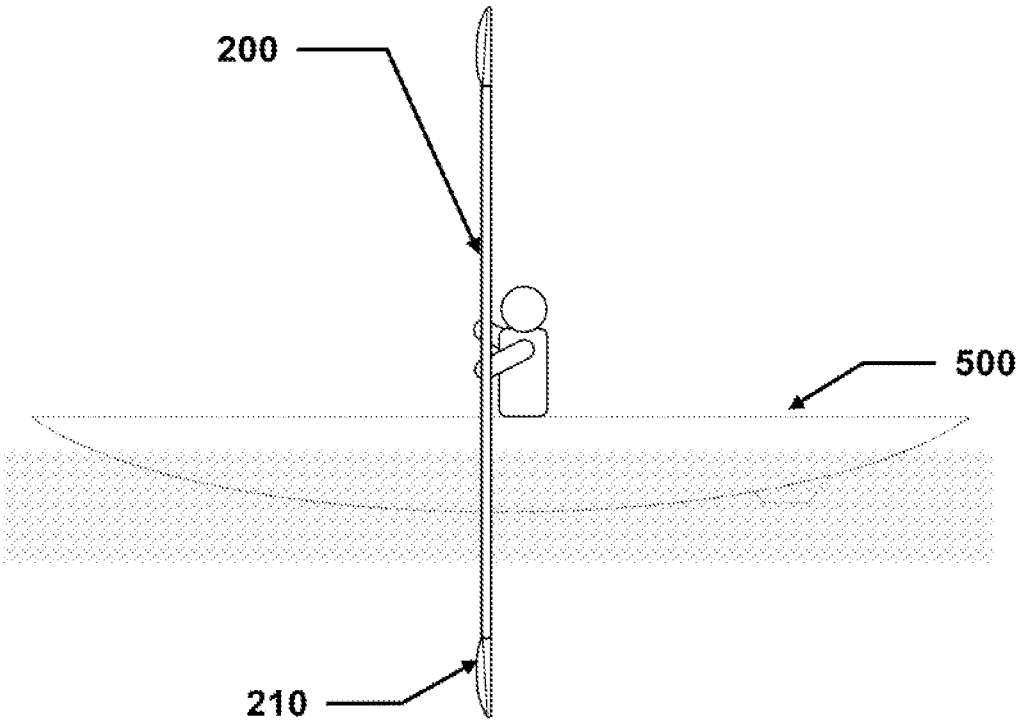
FIG. 6*b* is a side schematic view of the pulling movement of the hydro-impelled paddle of this invention while paddling.

Pull.—During the pull movement, FIGS. 6*a* and 6*b*, the blade, deep but close to the kayak hull gets "stuck" in the water moving the boat forward ("Z").

Figure 7A:
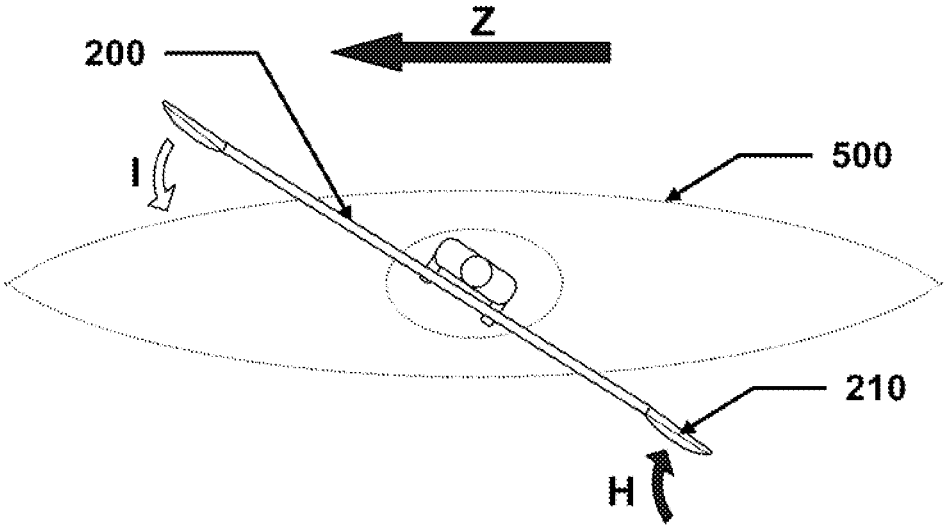
FIG. 7*a* is a top schematic view of the retrieval movement of the hydro-impelled paddle of this invention while paddling.
Figure 7B:
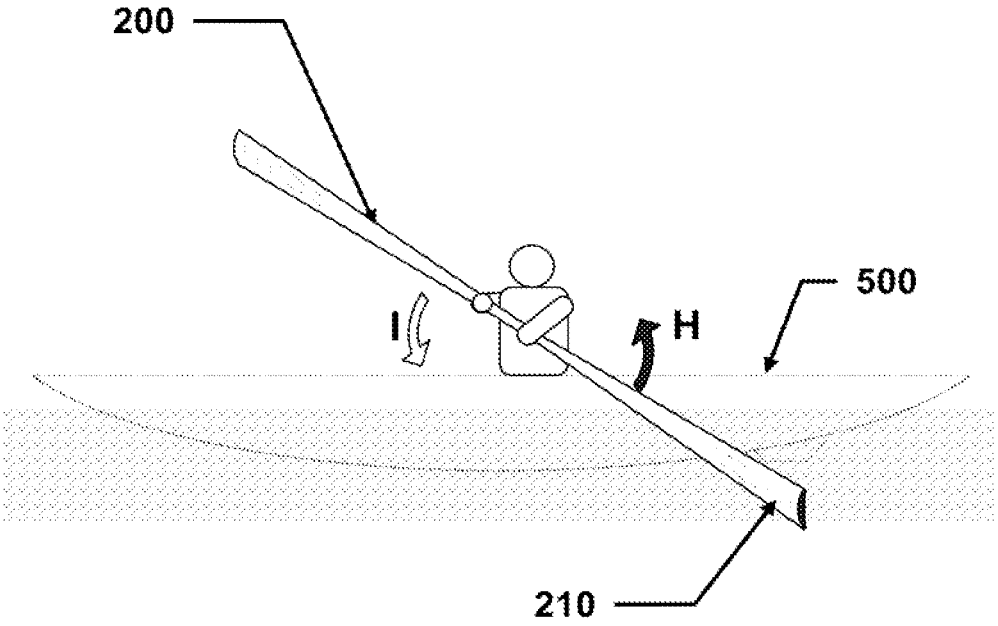
FIG. 7*b* is a side schematic view of the retrieval movement of the hydro-impelled paddle of this invention while paddling.
Figure 8:
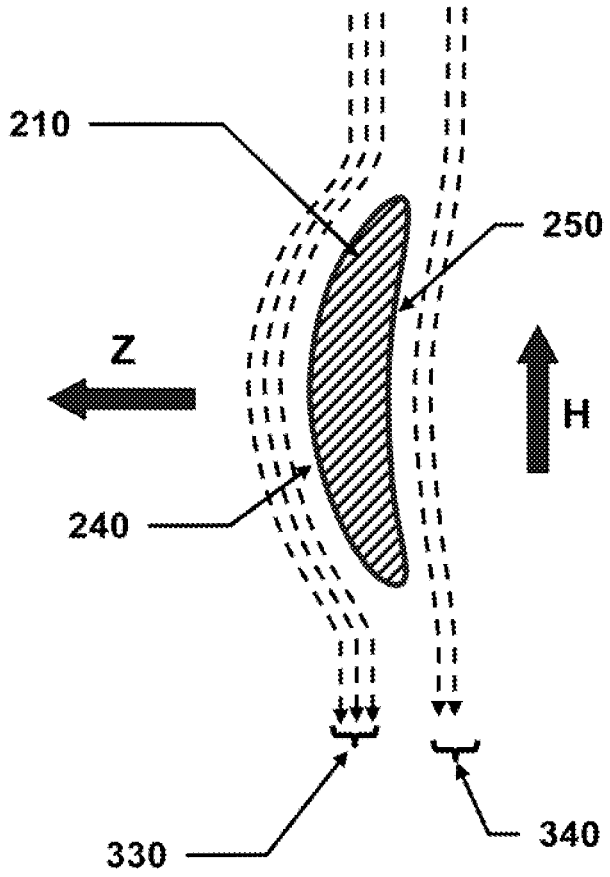
FIG. 8 is a schematic view of the flow pattern produced by the hydro-impelled paddle of the invention during the retrieval vertical movement.

Extraction, or Retrieval.—During retrieval, represented schematically on FIG. 7*a* on a top view and on FIG. 7*b* on a side view, the deep blade (210) is displaced vertically upwards ("H") while the other extreme is brought downwards ("I") to start a new paddling cycle on the other side of the kayak (500). Bringing the paddle upwards (200) produces the flow pattern shown on FIG. 8, following the curvature on the frontal face (240) as if water would come down (330), and in the back face (250) following an almost straight pattern (340). This water flow lines difference (330) and (340), that generates a pressure change, being less in the front, powers the kayak forward in the "Z" direction according to "Bernoulli" principle.

The three motion movements occur with the paddle (200) near or very close to the kayak body (500).

In the insertion and retrieval stroke movements, the paddle (200) shows the blades (210) curved face (240) in the forward side or forward kayak motion "Z" direction. During insertion the lower edge (220) is leader, while in the retrieval, the upper edge (230) is leader. Both edges (220), (230) show a slight curvature that softly cuts the water forcing the front water to follow the convexity of the front face and keeping the backside water almost without modification. This effect pushes the paddle forward according to Bernoulli principle, independently of the paddle descending or ascending.

As can be readily seen, the three movements contribute to the forward advancement of the vessel. This eliminates the uselessness (in terms of forward push) of the two movements of insertion and extraction.

The previous description and accompanying drawings illustrate the preferred embodiment of the paddle of this invention with frontal and back faces of the blade curved, it should be evident to a person with skills in the technical field that some modifications can be done, especially in the back face, to include a flat or channeled surface, for example, without altering substantially the paddle performance, as long as the straight or almost straight water flow patterns are kept as has been illustrated.

The description also includes a known paddling technique that allows a better appreciation of the effects of the shape with curvature on both upper and lower edge, and of the curved faces, and even though the paddler chooses his own style, it is recommended to use the proposed method, so as to obtain the most of the exerted forces during paddling, since it is evident from the modification that the insertion and exertion angle will have an important effect on the resulting movement due to forces acting on the kayak. The optimum attack and extract angle will have to be tuned up to achieve the maximum effect with the relative motions of kayak, paddle and water.

I claim:

1. A paddle comprising:

a shaft having a first end and a second end;

a first blade affixed to or formed with said first end of said shaft; and a second blade affixed to or formed with said second end of said shaft, wherein said first and second blades are extensions from said shaft, each of the first and second blades have a cross-section with a front face and a back face, said front face has a convex curved shape, each of said first and second blades has an upper edge and a lower edge, the upper edge and the lower edge are curved, said back face is not convex, said cross-section smoothing from an end of the paddle opposite said shaft toward an oval shape adjacent said shaft so as to define an area that can be grasped by a hand of a user, the curved shape of said first and second paddles adapted to generate a momentum through insertion, pull and retrieval paddling motions.

2. The paddle of claim 1, said back face having a concave surface.

3. The paddle of claim 1, said back face being a flat surface.

4. The paddle of claim 1, said back face having a channeled surface.

* * * * *